US006945237B1

(12) United States Patent
Sullivan et al.

(10) Patent No.: US 6,945,237 B1
(45) Date of Patent: Sep. 20, 2005

(54) INTAKE MANIFOLD WITH EGR/AIR MIXING

(75) Inventors: Michael Brian Sullivan, Cedar Falls, IA (US); Nathan Daniel Carlson, Cedar Falls, IA (US); Jack Glen Stabenow, Waterloo, IA (US)

(73) Assignee: Deere & Company, Moline, IL (US)

( * ) Notice: Subject to any disclaimer, the term of this patent is extended or adjusted under 35 U.S.C. 154(b) by 0 days.

(21) Appl. No.: 10/801,752

(22) Filed: Mar. 15, 2004

(51) Int. Cl.[7] ..... F02B 47/08
(52) U.S. Cl. ..... 123/568.17
(58) Field of Search ..... 123/568.11, 568.17, 123/568.18, 184.21, 184.31, 184.33, 184.34, 123/184.35, 184.39, 184.41, 184.42

(56) References Cited

U.S. PATENT DOCUMENTS

| | | | | |
|---|---|---|---|---|
| 1,539,126 A * | 5/1925 | Link | 123/568.17 |
| 3,717,130 A | 2/1973 | Thornburgh | 123/184.33 |
| 3,717,131 A | 2/1973 | Chana et al. | 123/184.35 |
| 3,892,026 A | 7/1975 | Thornburgh | 29/890.08 |
| 4,072,133 A | 2/1978 | McWhirter | 123/184.35 |
| 4,135,481 A * | 1/1979 | Resler, Jr. | 123/568.17 |
| 4,327,698 A * | 5/1982 | Hamai et al. | 123/568.17 |
| 4,870,941 A | 10/1989 | Hisatomi | 123/676 |
| 5,207,714 A | 5/1993 | Hayashi et al. | 123/568.17 |
| 5,490,488 A | 2/1996 | Aversa et al. | 123/568.12 |
| 5,492,104 A | 2/1996 | Elder et al. | 123/568.17 |
| 5,884,612 A * | 3/1999 | Takeyama et al. | 123/568.17 |
| 5,957,116 A | 9/1999 | Haegele et al. | 123/568.12 |
| 6,446,617 B2 * | 9/2002 | Bianchi et al. | 123/568.17 |

* cited by examiner

*Primary Examiner*—Willis R. Wolfe, Jr.

(57) ABSTRACT

An intake manifold mixes and supplies air and exhaust recirculation gas (EGR) to an internal combustion engine. The manifold is a casting and includes an air intake port, an intake chamber receiving intake air from the intake port, an outlet plenum communicated with the engine, an EGR inlet port, and first and second EGR valve chambers. A first EGR passage communicates the EGR inlet port with the first EGR valve chamber. A second EGR passage communicates the EGR inlet port with the second EGR valve chamber. A central EGR outlet passage communicates an end of each EGR valve chamber with a central portion of the plenum. First and second EGR outlet chambers receive EGR from the first and second valve chambers, and have outlet ports which communicate with first and second ends of the plenum. A wall separates the intake chamber from the central EGR outlet passage chamber and from one of the EGR inlet passages. The wall creating turbulence as the EGR from the central EGR outlet passage mixes with intake air from the intake chamber.

11 Claims, 7 Drawing Sheets

INTAKE MANIFOLD WITH EGR/AIR MIXING

BACKGROUND

The present invention relates to an intake manifold which mixes recirculated exhaust gas (EGR) with the fresh air for a diesel engine.

There is a need for a diesel engine which meets Tier 3 emission regulations. To effectively meet the emissions requirements with minimal impact of fuel economy and engine durability, the EGR and fresh air must be evenly mixed and evenly distributed among the cylinders. Previously, EGR and fresh intake air has been mixed with apparatus which includes venturi type inlets, or mixing devices which require additional parts and controls.

To reduce costs, it would also be desirable to have an engine EGR system which permits EGR flow rate to be determined by measuring a temperature differential and without sensing a pressure differential across a flow element such as a venture and without using a flow meter. This requires even EGR/fresh air mixing. But, it very difficult to mix EGR and air evenly and quickly because EGR and fresh air have significantly different densities.

It would also be desirable to have an EGR/fresh air mixing intake manifold which can be placed in different orientations so that the fresh air intake can be oriented upwardly or downwardly.

SUMMARY

Accordingly, an object of this invention is to provide an intake manifold which mixes EGR with the fresh air for a diesel engine.

A further object of the invention is to provide such an intake manifold in which EGR and fresh air are evenly mixed and evenly distributed among the cylinders.

A further object of the invention is to provide such an intake manifold in which EGR flow rate can be determined by measuring a temperature differential.

A further object of the invention is to provide such an intake manifold which can be placed in different orientations so that the fresh air intake can be oriented upwardly or downwardly.

These and other objects are achieved by the present invention, wherein an intake manifold mixes EGR and air and supplies the mixed air and exhaust gas to an internal combustion engine. The manifold is a casting which forms a housing which is attached to a side of an engine. The housing has an EGR inlet and an outlet plenum. A fresh air intake projects from one side of the manifold. A pair of EGR inlet passages communicate EGR from the EGR inlet to respective ones of a pair of spaced apart EGR valve chambers in which EGR valves are mounted. A pair of EGR outlet chambers communicate from the valve chambers to outlet ports which communicate with the plenum. A central EGR outlet passage communicates EGR to a central part of the plenum. The manifold forms a wall or shelf which causes turbulence in the intake air and which separates the central EGR passage from the intake air. The wall forms an edge beyond which the central EGR passage and an intake chamber merge into the plenum.

DETAILED DESCRIPTION

Figure 1:
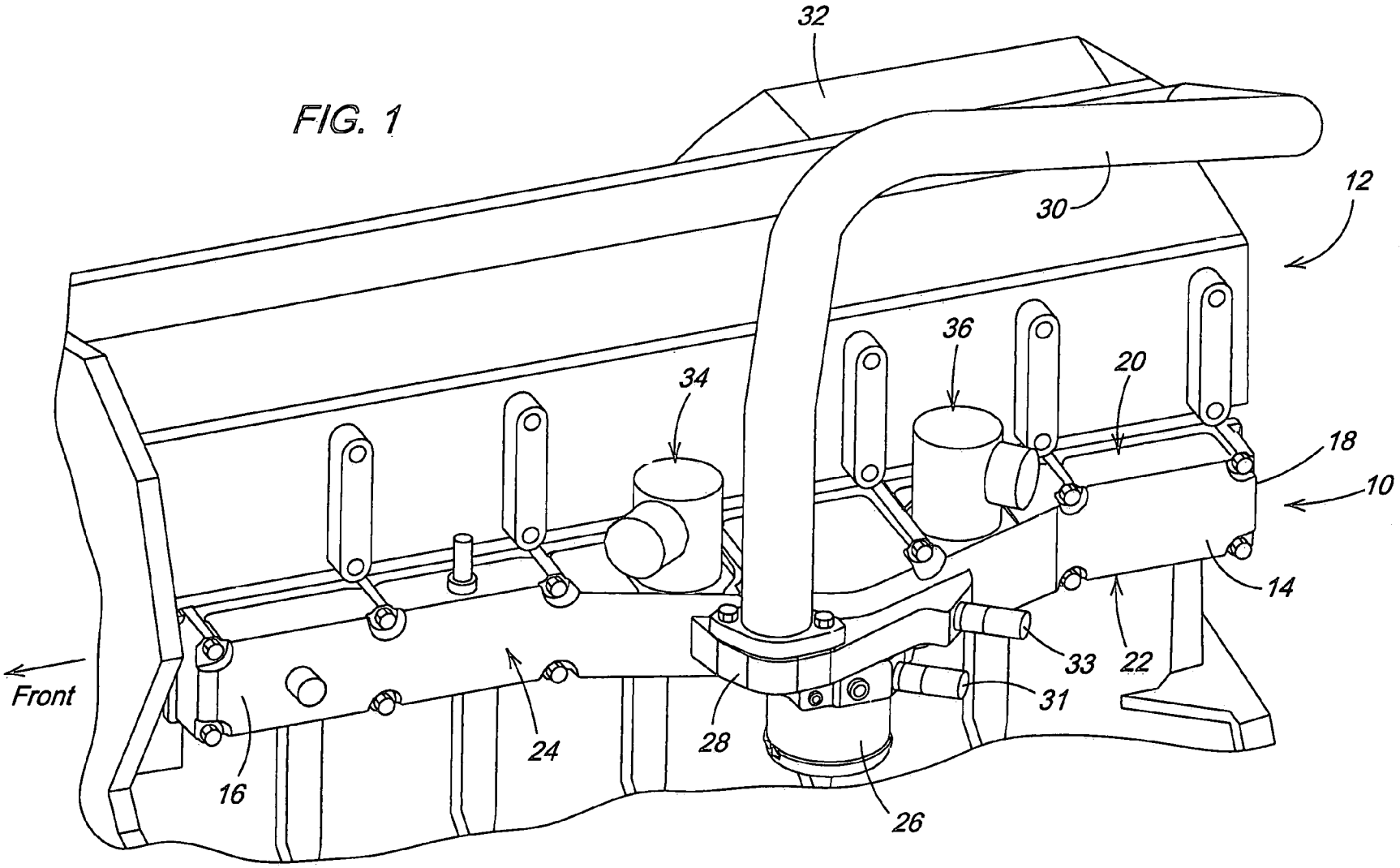
FIG. 1 is a perspective view of the manifold of the present invention mounted on the side of an engine.
Figure 2:
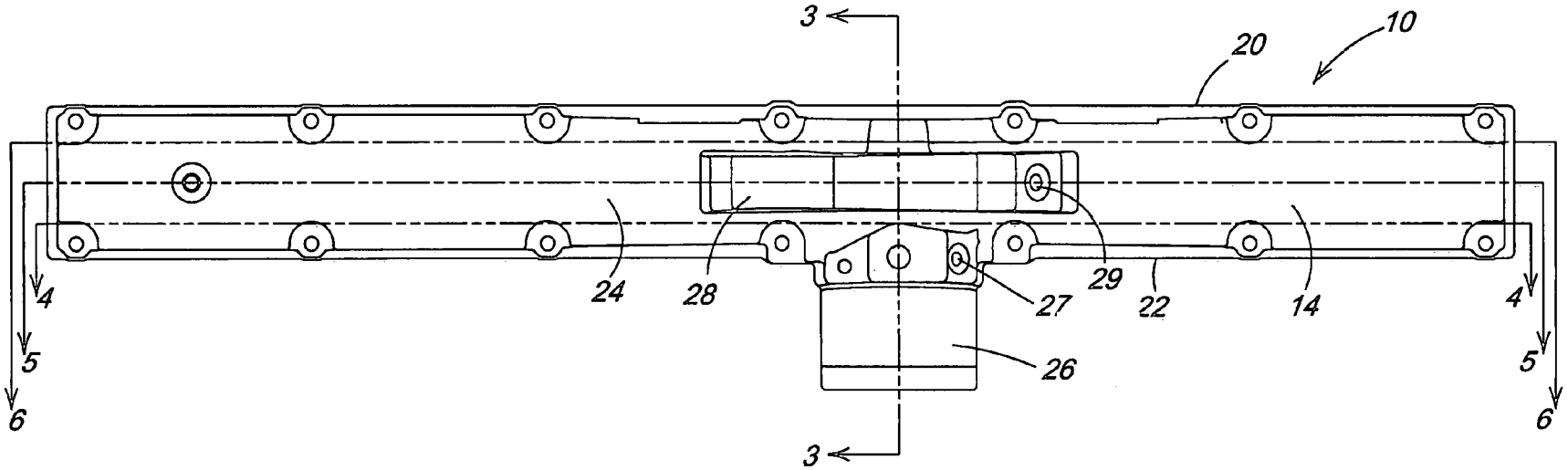
FIG. 2 is a side elevation view of the manifold of FIG. 1.
Figure 3:
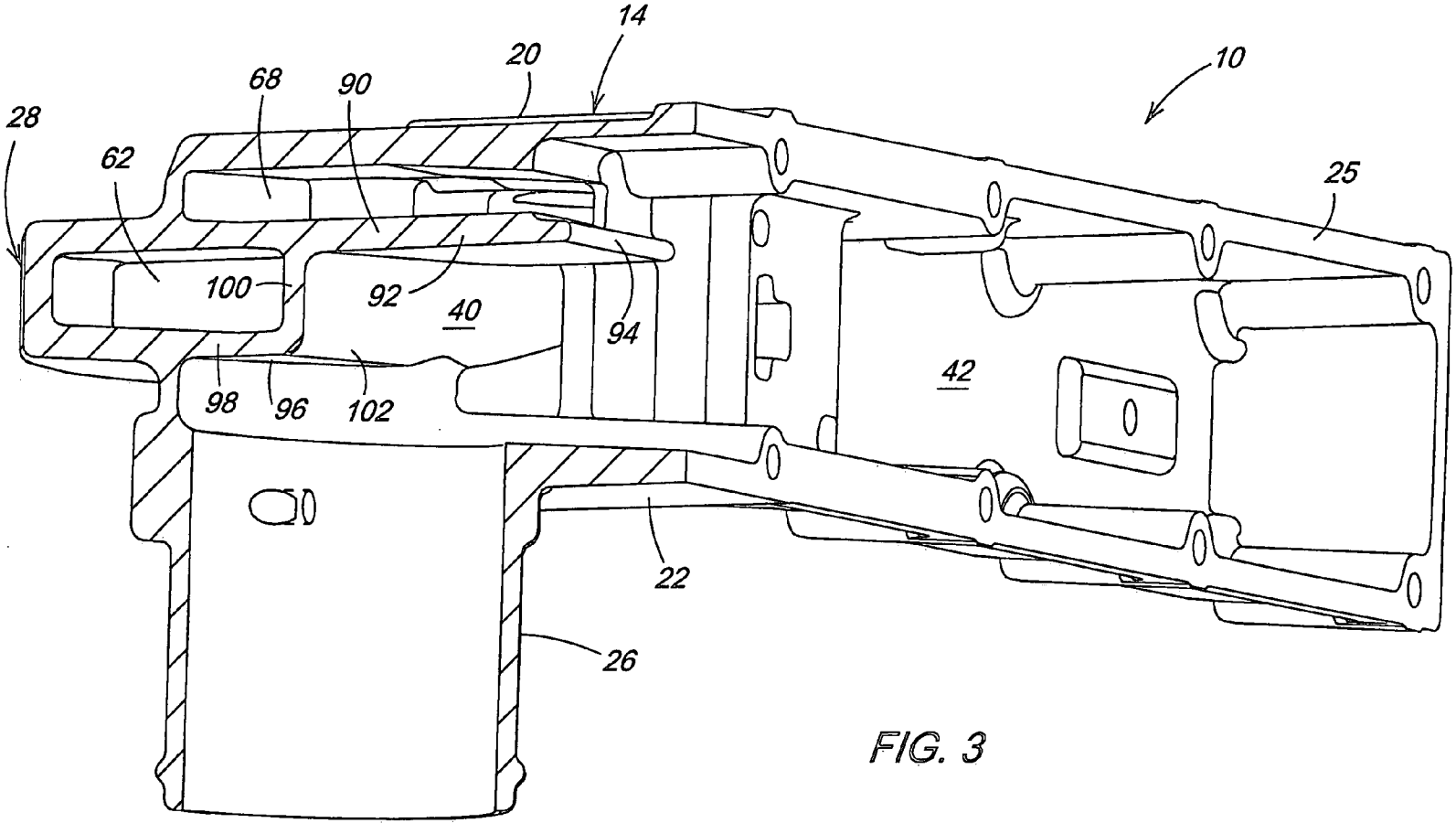
FIG. 3 is a view taken along lines 3—3 of FIG. 2.

Referring to FIGS. 1, 2 and 3, an intake manifold 10 is mounted on the side of an engine 12. The manifold 10 supplies air and recirculated exhaust gas (EGR) to the engine 12 having combustion chambers (not shown). The manifold 10 is preferably a casting.

The manifold 10 has an outer housing 14 which has first and second ends 16, 18 extending in fore and aft directions, spaced apart first and second sides 20, 22, both extending generally horizontally, an outer wall 24 joining the first and second sides to each other and an inner surface 25 which sealingly engages the engine 12. Housing 14 forms an air intake 26 which projects away from side 22. A temperature sensor port 27 is formed in intake 26 for receiving a conventional temperature sensor 31 for sensing the temperature of intake air therein. Housing 14 forms an EGR inlet subhousing 28 which projects away from the engine side of the manifold 10. An EGR conduit 30 communicates EGR from EGR cooler 32 to the subhousing 28. A temperature sensor port 29 is formed in subhousing 28 for receiving a conventional temperature sensor 33 for sensing the temperature of the EGR therein. A pair of EGR control valve assemblies 34, 36 are inserted through side 20 and into manifold 10. As best seen in FIG. 3, the housing 14 forms an intake chamber 40 and an outlet plenum 42. Intake air flows from intake 26 through chamber 40 to plenum 42.

Figure 5:
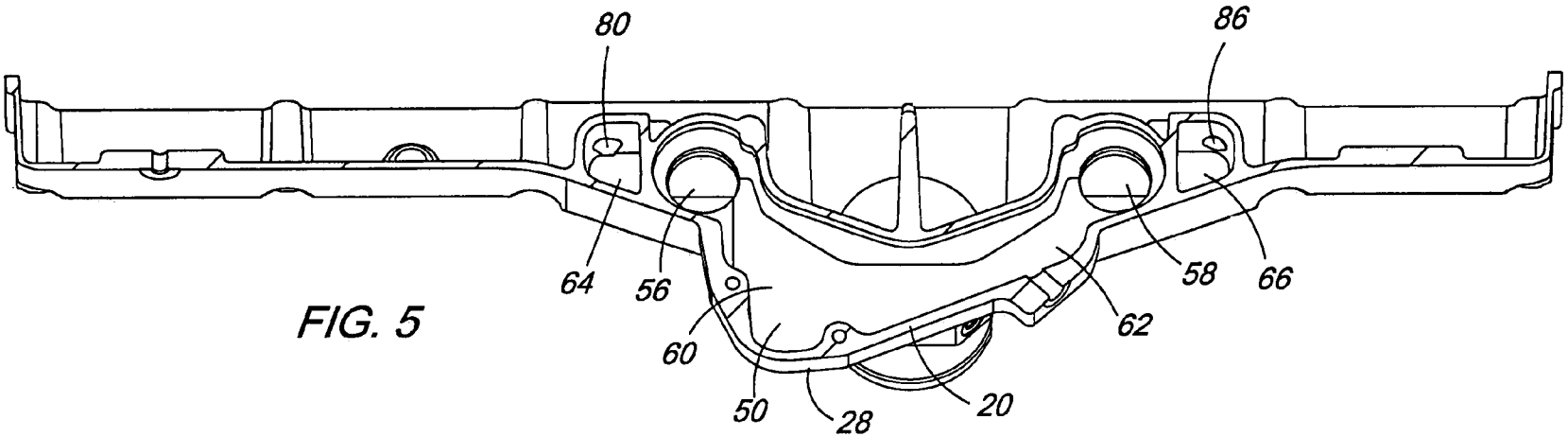
FIG. 5 is a perspective view taken along lines 5—5 of FIG. 2.
Figure 7:
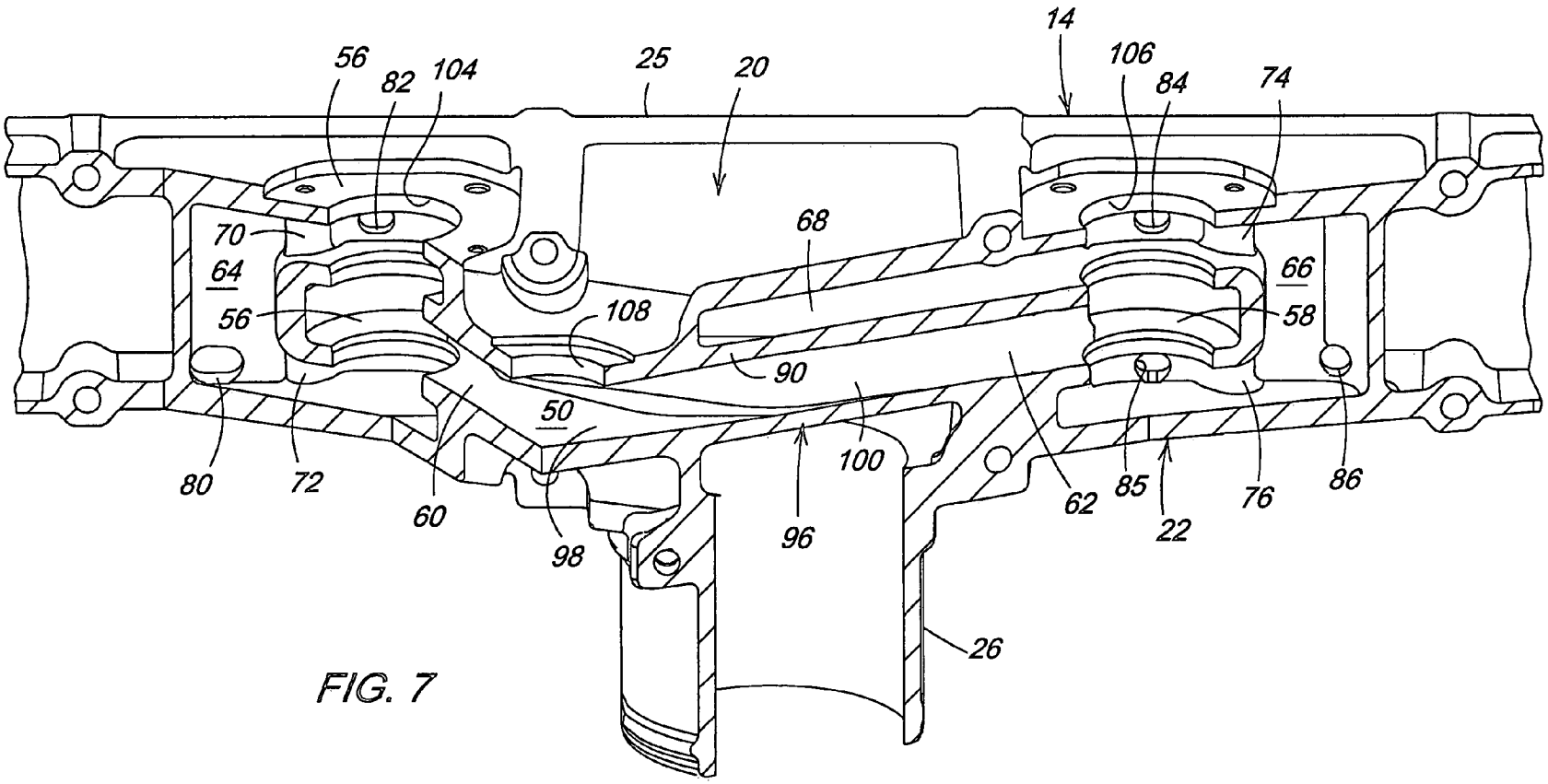
FIG. 7 is a perspective sectional view taken along lines 7—7 of FIG. 4.

As best seen in FIGS. 5 and 7, housing 14 forms an EGR inlet chamber 50 which extends between walls 90, 96. The EGR inlet chamber 50 is preferably formed at a location on or near the fore-and-aft center of the manifold. Housing 14 also forms a pair of EGR valve chambers 56, 58 which extend between sides 20, 22. A first EGR inlet passage 60 communicates EGR from EGR inlet chamber 50 to a central portion of valve chamber 56. A second EGR inlet passage 62 communicates EGR from EGR inlet chamber 50 to a central portion of valve chamber 58.

Figure 4:
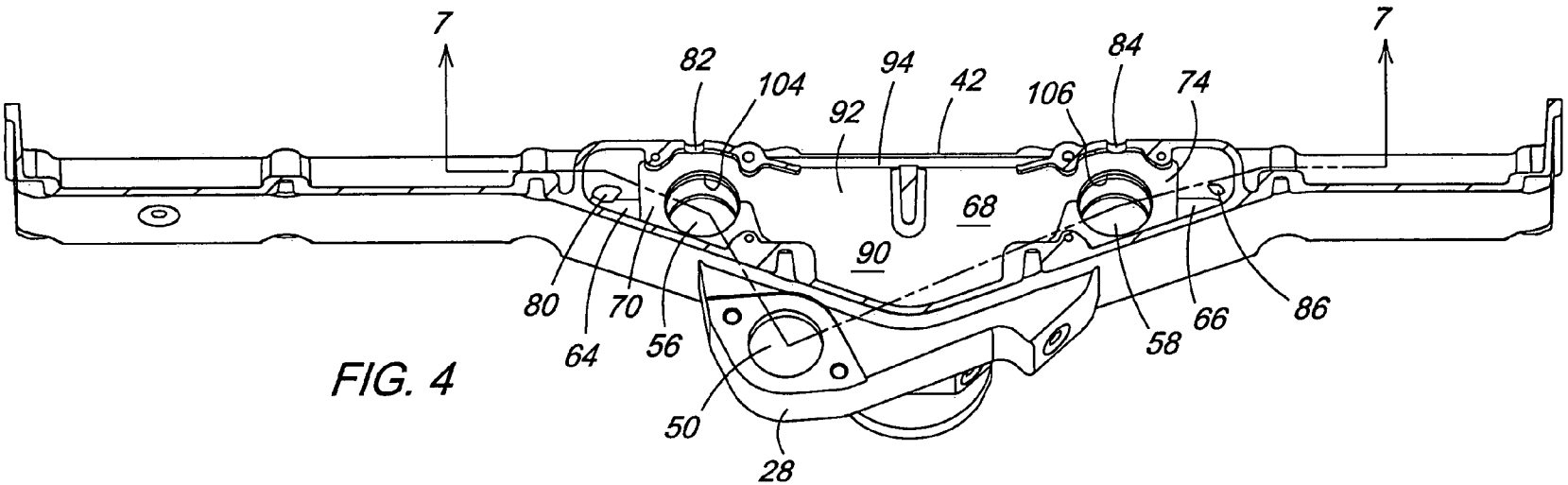
FIG. 4 is a view taken along lines 4—4 of FIG. 2.
Figure 6:
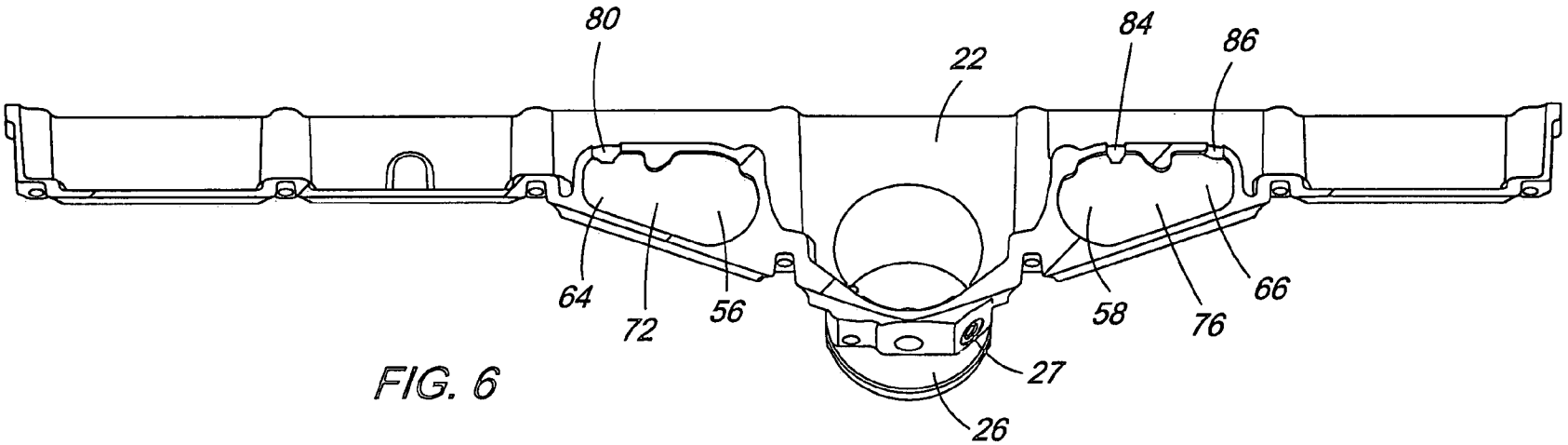
FIG. 6 is a view taken along lines 6—6 of FIG. 2.

Referring now to FIGS. 4, 6 and 7, housing 14 forms a first EGR outlet chamber 64 adjacent to valve chamber 56 and a second EGR outlet chamber 66 adjacent to valve chamber 58. A central EGR outlet passage 68 communicates the upper portion of valve chambers 56, 58 to plenum 42. A first upper EGR outlet passage 70 communicates an upper portion of valve chamber 56 to an upper portion of EGR outlet chamber 64. A first lower EGR outlet passage 72 communicates a lower portion of valve chamber 56 to a lower portion of EGR outlet chamber 64. A second upper EGR outlet passage 74 communicates an upper portion of valve chamber 58 to an upper portion of EGR outlet chamber 66. A second lower EGR outlet passage 76 communicates a lower portion of valve chamber 58 to a lower portion of EGR outlet chamber 66. Ports 80, 82, 84, 85 and 86 communicate EGR to the outlet plenum 42.

As best seen in FIGS. 3 and 7, housing 14 forms a wall 90 which separates passage 68 from passage 62 and from intake chamber 40. Wall 90 includes an inner portion or shelf 92 which projects substantially normal to the central axis of intake 26 to an edge 94 at which passage 68 and intake chamber 40 merge into outlet plenum 42. A wall 96 separates passage 62 from intake chamber 40. Wall 96 includes a generally horizontal wall 98 and a generally vertical wall 100 joined at a corner 102. The wall 96, corner 102 and shelf 92 create turbulence in the air intake stream which helps evenly and quickly mix the intake air with the EGR from passage 68. A bore 104 is machined through side 20 and walls 96 and 90 to receive EGR valve 34 in valve chamber 56. A bore 106 is machined through side 20 and walls 96 and 90 to receive EGR valve 36 in valve chamber 58. A bore 108 is machined through side 20 to provide an opening to which EGR supply conduit 30 is connected.

Figure 8:
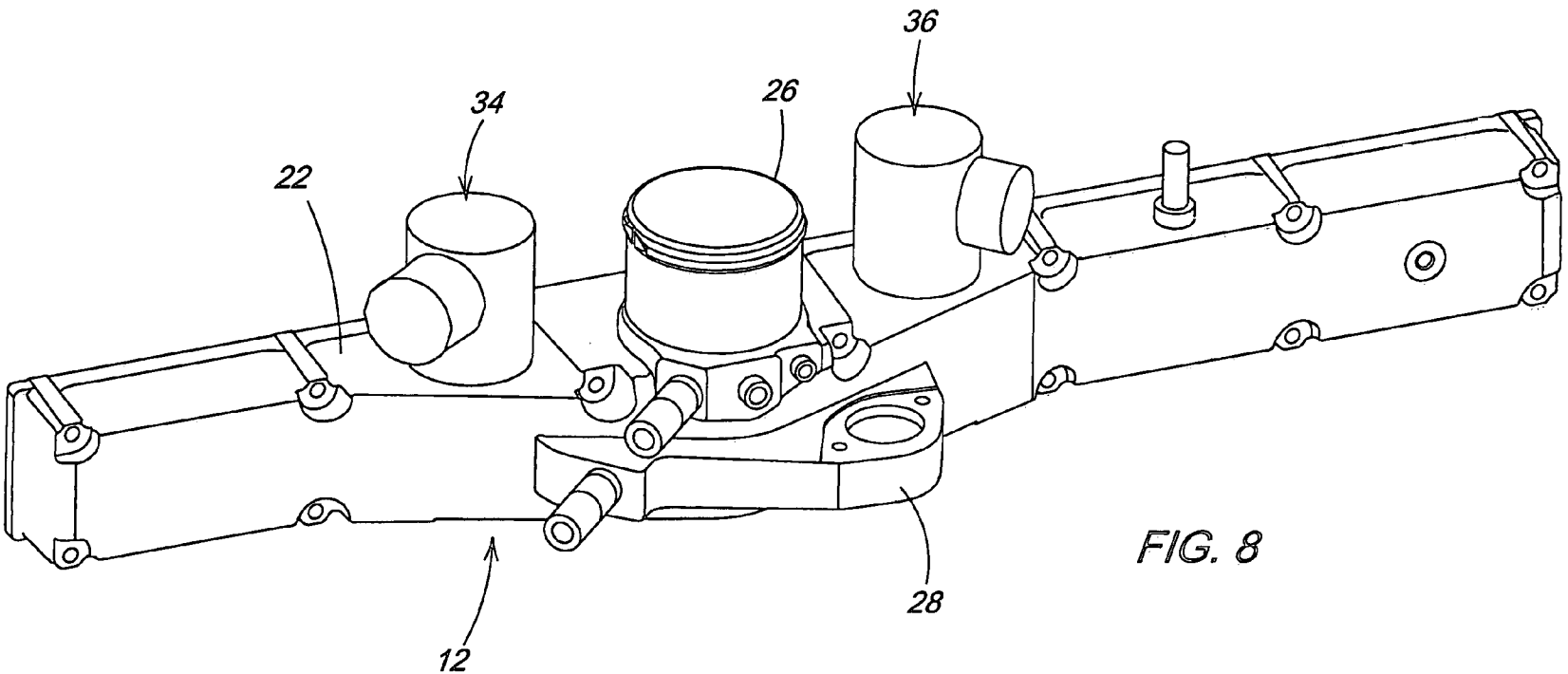
FIG. 8 is a perspective view of an embodiment of the manifold of the present invention with an upward opening air intake.

Alternatively, the bores 104, 106 and 108 could be machined through side 22 so that the manifold 10 can be flipped over and oriented as shown in FIG. 8 and have the air intake 26 projecting upwardly, while EGR valves 34, 36 and the EGR supply conduit 30 are still connected to the upper surface (now side 22) of the manifold 10.

The result is a single intake cover casting which has several specially tuned EGR distribution ports that mixes the EGR and intake air well. No venturis are needed to achieve EGR introduction and mixing. EGR and air are mixed quickly in a compact structure. The EGR supply tube and EGR valve mountings are aligned with the engine centerline and can be machined on either side of the manifold.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations within the spirit and scope of the appended claims.

We claim:

1. An intake manifold for supplying air and exhaust recirculation gas (EGR) to an internal combustion engine, the cast manifold comprising:

an air intake port;

an intake chamber receiving intake air from the intake port;

an outlet plenum communicated with the engine;

an EGR inlet port;

first and second spaced apart EGR valve chambers;

a first EGR passage communicating the EGR inlet port with the first EGR valve chamber;

a second EGR passage communicating the EGR inlet port with the second EGR valve chamber;

a central EGR outlet passage communicating an end of each EGR valve chamber with a central portion of the plenum;

a first EGR outlet chamber receiving EGR from the first EGR valve chamber and having outlet ports communicating with a first end of the plenum;

a second EGR outlet chamber receiving EGR from the second EGR valve chamber and having outlet ports communicating with a second end of the plenum; and a wall separating the intake chamber from the central EGR outlet passage chamber and from one of the EGR inlet passages, said wall creating turbulence in the intake air as the EGR from the central EGR outlet passage mixes with intake air from the intake chamber.

2. The intake manifold of claim 1, wherein:

at least a portion of the wall extends substantially normal to a central axis of the intake port.

3. The intake manifold of claim 1, wherein:

the wall comprises a first wall portion extending substantially normal to a central axis of the intake port, a second wall portion extending substantially parallel to a central axis of the intake port and a third wall portion extending substantially normal to a central axis of the intake port, the second wall portion extending from the first wall portion to the second wall portion.

4. The intake manifold of claim 3, wherein:

the first and second wall portions join at a corner which is exposed to air flowing from the air intake port.

5. The intake manifold of claim 1, further comprising:

a first upper EGR passage communicating EGR from an upper portion of the first EGR valve chamber to an upper portion of the first EGR outlet chamber, a first lower EGR passage communicating EGR from a lower portion of the first EGR valve chamber to a lower portion of the first end EGR outlet chamber; and a second upper EGR passage communicating EGR from an upper portion of the second EGR valve chamber to an upper portion of the second EGR outlet chamber, a second lower EGR passage communicating EGR from a lower portion of the second EGR valve chamber to a lower portion of the second EGR outlet chamber.

6. An intake manifold for supplying air and exhaust recirculation gas (EGR) to an internal combustion engine, the manifold comprising:

a generally vertical air intake port;

an intake chamber receiving intake air from the intake port;

a generally vertical EGR inlet port having a central axis spaced apart from a central axis of the intake port;

a first generally vertically extending EGR valve chamber;

a second generally vertically extending EGR valve chamber;

a first EGR passage communicating the EGR inlet port with the first EGR valve chamber;

a second EGR passage communicating the EGR inlet port with the second EGR valve chamber;

a central EGR chamber communicating an upper portion of the first EGR valve chamber with an upper portion of the second EGR valve chamber;

an outlet plenum communicated with the engine, the intake chamber and the central EGR chamber;

a central EGR outlet communicating the central EGR chamber to the outlet plenum; and a wall separating the central EGR chamber from the intake chamber and extending substantially normal to the central axis of the intake port, said wall creating turbulence in the intake air as the EGR from the central EGR chamber mixes with intake air from the intake chamber.

7. The intake manifold of claim 6, further comprising:

a end EGR chamber, an upper EGR passage communicating EGR from an upper portion of the first EGR valve chamber to an upper portion of the end EGR chamber, a lower EGR passage communicating EGR from a lower portion of the first EGR valve chamber to a lower portion of the end EGR chamber, and an end EGR outlet for communicating the end EGR chamber with the outlet plenum.

8. The intake manifold of claim 6, further comprising:

a first end EGR chamber, a first upper EGR passage communicating EGR from an upper portion of the first EGR valve chamber to an upper portion of the first end EGR chamber, a first lower EGR passage communicating EGR from a lower portion of the first EGR valve chamber to a lower portion of the first end EGR chamber, and a first end EGR outlet for communicating the first end EGR chamber with the outlet plenum; and a second end EGR chamber, a second upper EGR passage communicating EGR from an upper portion of the second EGR valve chamber to an upper portion of the second end EGR chamber, a second lower EGR passage communicating EGR from a lower portion of the second EGR valve chamber to a lower portion of the second end EGR chamber, and a second end EGR outlet for communicating the second end EGR chamber with the outlet plenum.

9. An intake manifold for supplying air and exhaust recirculation gas (EGR) to an internal combustion engine, the cast manifold comprising:

an air intake port;

an intake chamber receiving intake air from the intake port;

an outlet plenum communicated with the engine;

an EGR inlet port;

an EGR outlet passage communicating the EGR inlet port with the plenum;

a wall separating the intake chamber from the EGR outlet passage, said wall creating turbulence in the intake air as the EGR from the EGR outlet passage mixes with intake air from the intake chamber, at least a portion of the wall extends substantially normal to a central axis of the intake port.

10. The intake manifold of claim 9, wherein:

the wall comprises a first wall portion extending substantially normal to a central axis of the intake port, a second wall portion extending substantially parallel to a central axis of the intake port and a third wall portion extending substantially normal to a central axis of the intake port, the second wall portion extending from the first wall portion to the second wall portion.

11. The intake manifold of claim 10, wherein:

the first and second wall portions join at a corner which is exposed to air flowing from the air intake port.

* * * * *